US007999199B2

(12) United States Patent
Villain

(10) Patent No.: US 7,999,199 B2
(45) **Date of Patent: *Aug. 16, 2011**

(54) ELECTRIC COMMUTATOR WITH MULTIPLE SWITCH WAYS

(75) Inventor: Jean-Christophe Villain, Dole (FR)

(73) Assignee: CoActive Technologies, LLC., Newton, MA (US)

( * ) Notice: Subject to any disclaimer, the term of this patent is extended or adjusted under 35 U.S.C. 154(b) by 1137 days.

This patent is subject to a terminal disclaimer.

(21) Appl. No.: 11/784,788

(22) Filed: Apr. 10, 2007

(65) Prior Publication Data

US 2007/0236463 A1 Oct. 11, 2007

(30) Foreign Application Priority Data

Apr. 11, 2006 (FR) ..... 06 51319

(51) Int. Cl.
*H01H 13/70* (2006.01)

(52) U.S. Cl. ..... 200/5 R; 200/1 R; 200/4; 200/17 R; 200/18

(58) Field of Classification Search ..... 200/1 R, 200/5 R, 6 R, 6 A, 329, 341, 345, 4, 17 R, 200/18; 341/20, 22, 31, 32, 33, 34; 400/472, 400/490, 491, 491.2

See application file for complete search history.

(56) References Cited

U.S. PATENT DOCUMENTS

| | | | | |
|---|---|---|---|---|
| 5,621,196 | A * | 4/1997 | Nishijima et al. | 200/6 A |
| 6,369,803 | B2 * | 4/2002 | Brisebois et al. | 345/173 |
| 6,586,690 | B2 * | 7/2003 | Shimomura et al. | 200/6 A |
| 6,657,141 | B1 * | 12/2003 | Myojin | 200/6 A |
| 6,771,992 | B1 * | 8/2004 | Tomura et al. | 455/575.1 |
| 7,297,883 | B2 * | 11/2007 | Rochon et al. | 200/5 R |
| 2001/0006143 | A1 | 7/2001 | Sato | |
| 2001/0023816 | A1 | 9/2001 | Kuriyama | |
| 2009/0095611 | A1 * | 4/2009 | Villain et al. | 200/5 A |

FOREIGN PATENT DOCUMENTS

| | | |
|---|---|---|
| FR | 2 875 024 | 3/2006 |
| JP | 2000200141 A | 7/2000 |

* cited by examiner

*Primary Examiner* — My-Chau T Tran
(74) *Attorney, Agent, or Firm* — Pepper Hamilton LLP

(57) ABSTRACT

An electric commutator (20) with multiple switch ways comprising a horizontal upper panel (24) with an upper face (24*s*) that can be contacted by a pointing element, a supporting frame (22) and means (26) for locating the point of contact of the pointing element on the horizontal upper face (24*s*) *of the upper panel (*24) that comprise a plurality of electric switches (28) on the supporting frame (22) that are capable of being actuated selectively by the upper panel (24). The switches (28) are distributed on the supporting frame (22) so as to divide the horizontal upper face (24*s*) of the upper panel (24) into a plurality number of contact zones (44), the number of which contact zones (44) is greater than the number of switches (28).

19 Claims, 9 Drawing Sheets

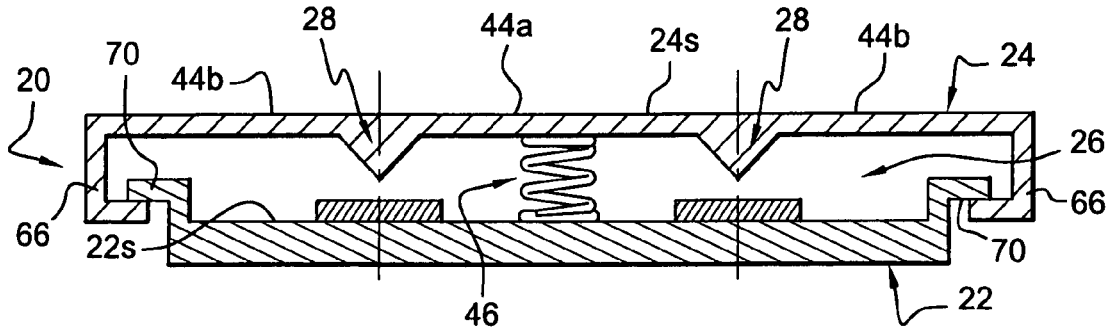
Fig. 2A
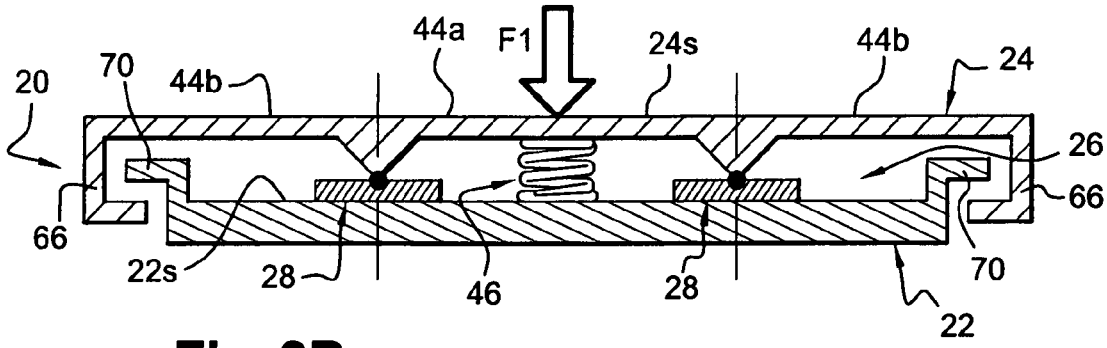
Fig. 2B
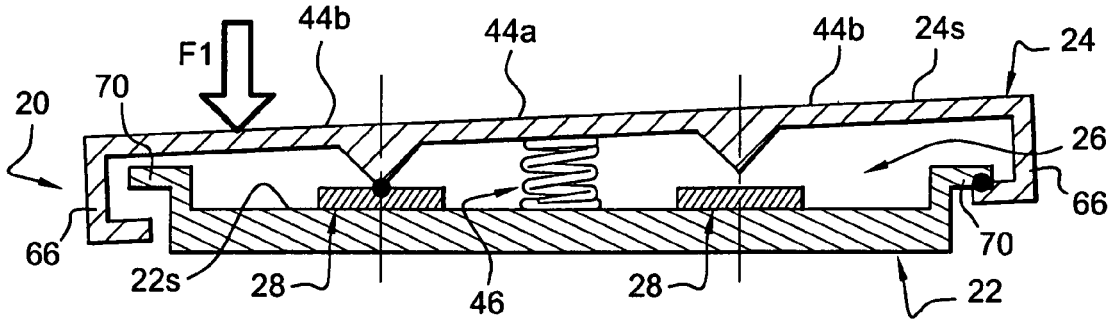
Fig. 2C
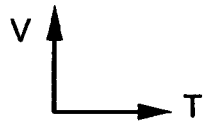

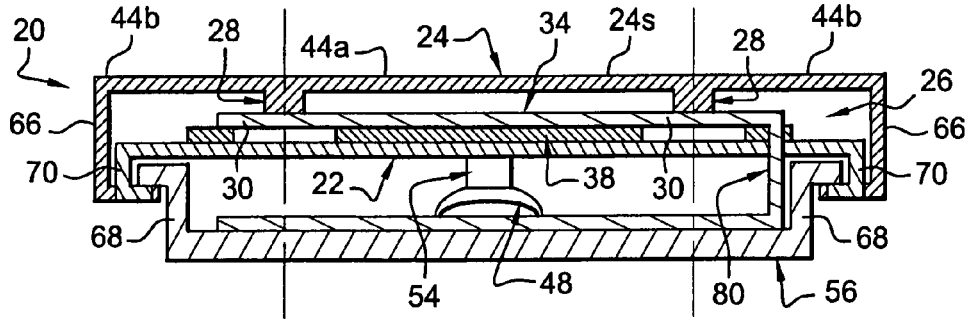
Fig. 7A
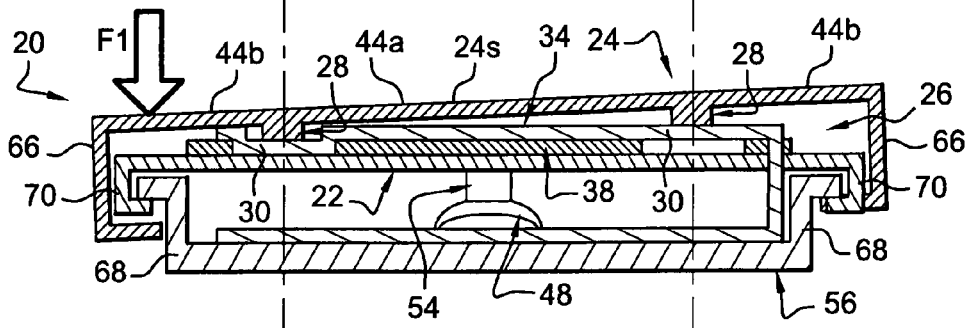
Fig. 7B
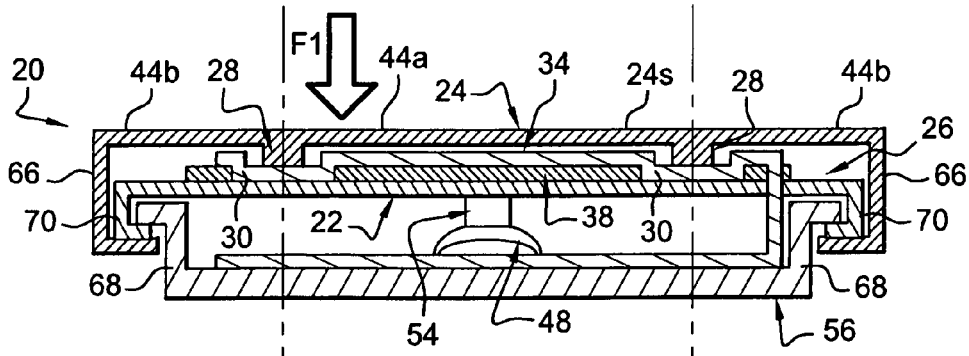
Fig. 7C
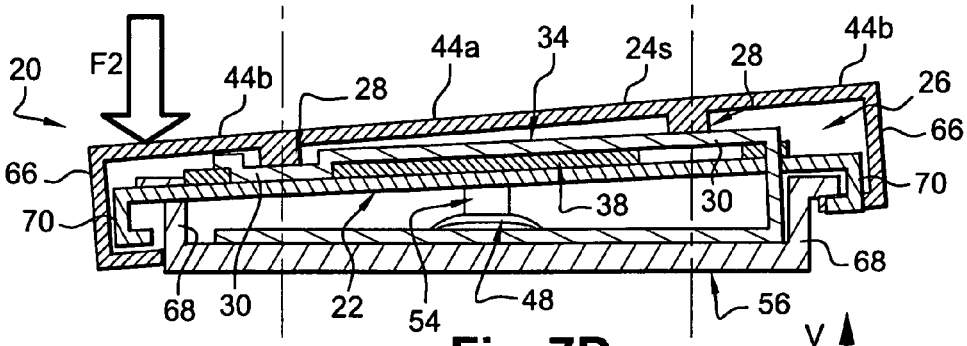
Fig. 7D
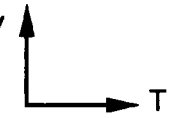

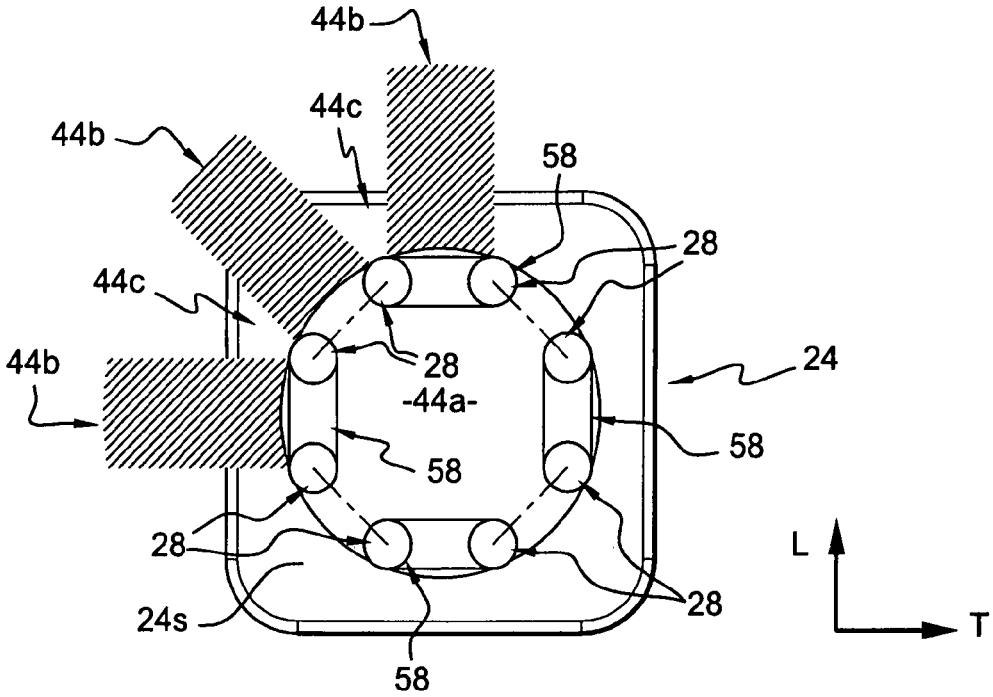
Fig. 10
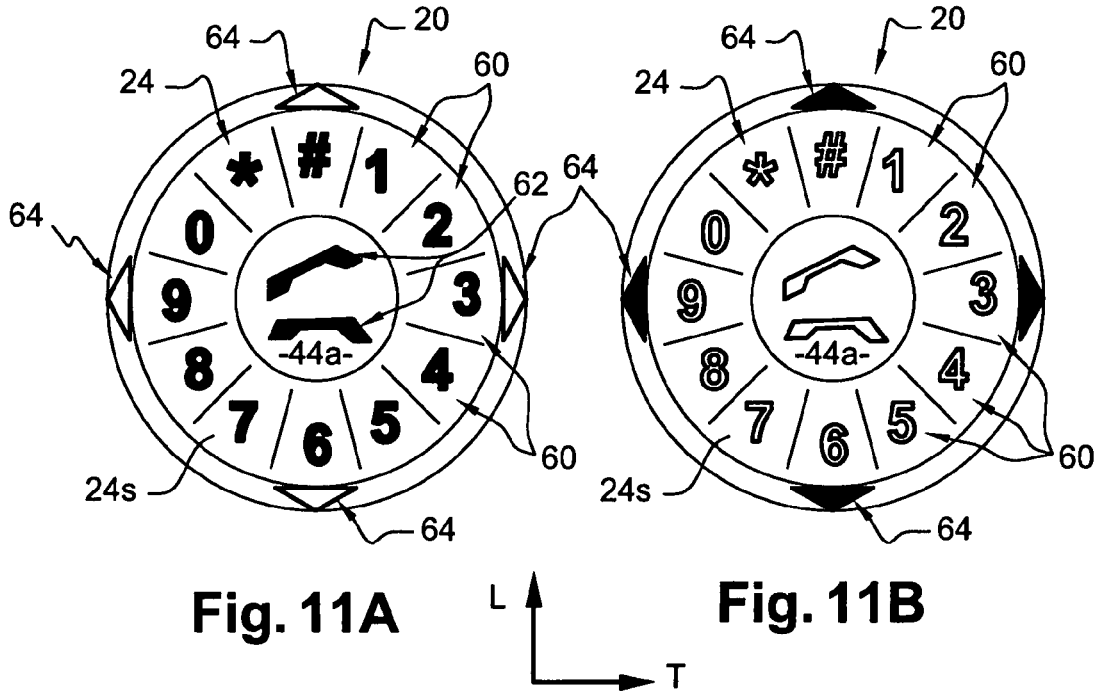
Fig. 11A
Fig. 11B

ELECTRIC COMMUTATOR WITH MULTIPLE SWITCH WAYS

CROSS-REFERENCE TO RELATED APPLICATION

Applicant claims priority from French patent application S.N. 0651319 filed Apr. 11, 2006.

BACKGROUND OF THE INVENTION

The invention relates to an electric commutator with several switch ways distributed about a vertical principal axis of the actuator.

Recent developments and the rapid evolution of telecommunication means, such as mobile telephones, laptop computers and other devices require more control. One type of control requires moving accurately and quickly a cursor on a screen. The equipment requires electromechanical components of reduced dimensions and the need to allow the scanning of menus, the movement of a symbol on a screen and, more generally, the combination in a single component of several electric switching functions.

It is especially desirable, in the case of an application to a mobile telephone (for example GSM or UMTS), whose dimensions are increasingly reduced, and that must be able to be handled and controlled by the user with one hand, that such a multiple switch should be able to be manipulated with a single digit, for example the thumb, while being implanted on the main front face of the telephone comprising in particular the keypad, or on one of the two main lateral edges of the telephone casing, or under the main face of the telephone.

The requirement for a compact and very small-dimensioned control device making it possible to move a cursor on a screen, and/or to scroll menus (Scanning), also called a "browser", is increasingly important on apparatus of the "mobile telephone" or "Personal Digital Assistant" type offering an increasing number of functions and services in particular requiring choices proposed on one or more screens, similar to the use of a laptop computer, or else portable items of apparatus processing digitized sound files, for example according to the "MP3" standard.

It is therefore desirable to have an electric commutator with multiple switch ways making use of a single actuation member that can be operated with one finger.

Such operations, for example by means of the underside of the thumb of the hand that holds the apparatus, must be easy and be able to be carried out in the largest possible number of directions, with very great user-friendliness and low operating forces (less than 2 Newtons).

In addition, such a miniaturized component must provide its user with a tactile sensation reflecting the validity of the operations carried out.

The tactile sensation transmitted by the commutator to the user is a very important parameter for its performance and its user-friendliness.

Document FR-A-2.875.024 describes an electric commutator comprising an element making it possible to generate a tactile sensation that is similar to a "click" of a conventional button, in response to a control action applied by the user to the commutator.

According to this document, the upper face of the upper panel is divided into several contact zones, with each of which the control element is capable of coming into contact. The commutator also comprises an electric commutator that is associated with each contact zone and that is actuated when the pointing element comes into contact with the associated contact zone.

Thus, the commutator comprises a number of switches that is equal to the number of contact zones, which causes connection problems, and an increase in the total cost of the commutator when the commutator comprises a large number of switches.

Document U.S. Pat. No. 6,686,906 describes an electric commutator comprising four switches that are arranged so that the upper face of the upper panel is divided into nine contact zones, and so that, when the pointing element is in contact with one or other of the contact zones, one or more switches are actuated.

According to said document, each switch comprises an element in the shape of an inverted dome that forms a disengageable stop of the upper panel, and that is capable of suddenly changing state when it is actuated to establish a switch way of the commutator. In addition, when contact of the pointing element with the upper panel is broken, the dome-shaped element deforms suddenly to resume its initial shape.

Each sudden change of state of this dome-shaped element is felt by the user manipulating the pointing element in the manner of a "click" of a button.

Consequently, when the pointing element comes into contact with a contact zone that is associated with two switches, the two dome-shaped elements of these two switches change state.

The state changes of the two dome-shaped elements are not usually simultaneous. The tactile sensation that is then felt by the user corresponds to two consecutive state changes, while the user has just applied a single control action; this may distract the user in his use of the electronic apparatus.

SUMMARY OF THE INVENTION

The object of the invention is to propose an electronic commutator that comprises fewer switch ways than the number of contact zones, and that generates no tactile sensation that can lead the user into error when actuating the commutator.

With this objective, the invention proposes a commutator of the type described above, characterized in that the switches are distributed on the supporting frame so as to divide the horizontal upper face of the upper panel into a plurality of contact zones, the number of which contact zones is greater than the number of switches, and so that, when the pointing element is in contact with one of the said contact zones, at least one switch that is associated with the said contact zone is actuated by the upper panel, and in that the upper panel is mounted so as to be movable relative to the supporting frame in a generally downward vertical movement, against an elastic return force of the upper panel to an initial position of which the value of the return force is continuously variable, so as to generate no tactile sensation in response to the action of the pointing element.

The invention proposes more particularly an electric commutator with multiple switch ways comprising:

- a horizontal upper panel with the upper face of which a pointing element is capable of coming into contact;
- a supporting frame;
- means for locating the point of contact of the pointing element on the horizontal upper face of the upper panel, comprising a plurality of electric switches that are arranged on the supporting frame and that are capable of being actuated selectively by the upper panel according to the location of the point of contact of the pointing element on the upper face of the upper panel, so that, when a switch is actuated, it applies to the upper panel a resistant force whose value is zero or continuously variable.

According to other features of the invention:

the commutator comprises a single element that is capable of generating a single mechanical impulse of vertical principal orientation on the upper panel under the action of the pointing element on the upper panel, irrespective of the number of switches that have been actuated by the upper panel;

the single element forms a disengageable stop of the upper panel in a high position that is capable of changing state to generate the mechanical impulse when the value of the pressure of the pressing element on the upper face of the upper panel is greater than a predefined threshold value;

the commutator comprises means for detecting at least one control action consisting in the application of a pressure on the upper face of the upper panel by means of the pointing element of which the value of the pressure is greater than or equal to the said predetermined threshold value, and irrespective of the contact zone with which the pointing element is in contact;

the disengageable element and the detection means consist of a single electronic switch that is arranged generally in line with the center of the upper panel;

the switches are arranged on the frame forming the points of a polygon whose center is situated generally in line with the center of the upper panel, and each contact zone is partly delimited by this polygon;

the upper face of the upper panel comprises a central contact zone that is arranged inside the said polygon, a first series of contact zones that are situated outside the polygon and each contact zone of which is associated with and is delimited by a side of the polygon, and a second series of contact zones that are situated outside the polygon and each contact zone of which is associated with a point of the polygon, so that the contact zones of the first series and of the second series are distributed alternately about the vertical principal axis of the upper panel;

each contact zone of the first series is associated with two adjacent switches delimiting the side of the polygon that is associated with the said contact zone;

each contact zone of the second series is associated with the switch forming the point of the polygon that is associated with the said contact zone;

the central contact zone is associated with at least two non-adjacent switches;

two adjacent switches are capable of establishing one and the same switch way so that the switch way associated with these two adjacent switches is established when the pointing element is in contact with the contact zone of the first series that is associated with these two adjacent switches or when the pointing element is in contact with one or other of the two contact zones of the second series that are arranged on either side of the said contact zone of the first series that is associated with these two switches;

the commutator comprises an intermediate plate that is arranged vertically between the supporting frame and the upper panel, and that is mounted so as to be movable relative to the frame and relative to the upper panel, so that the plate is capable of moving relative to the frame in a manner integral with the upper panel, when the value of the pressure is less than the threshold value, and so that the upper panel moves relative to the plate and relative to the frame when the value of the pressure is greater than the threshold value;

the upper panel is capable of actuating the switches by means of the intermediate plate, when the value of the pressure is less than the said threshold value;

the disengageable stop is arranged vertically between the upper panel and the intermediate plate, so that it is capable of applying the mechanical impulse directly to the upper panel;

the intermediate plate comprises a central orifice that is traversed by the disengageable stop so that the disengageable stop is arranged vertically between the supporting frame and the upper panel and so that the disengageable stop is capable of applying the mechanical impulse directly to the upper panel;

the commutator comprises a lower plate that is arranged vertically beneath the supporting frame and the upper panel, and relative to which the frame and the upper panel are movably mounted, so that the upper panel moves relative to the plate and relative to the frame when the value of the pressure is less than the threshold value, and so that the frame is capable of moving relative to the plate in a manner integral with the upper panel, when the value of the pressure is greater than the threshold value;

the upper panel is capable of actuating the switches directly when the value of the pressure is less than the said threshold value;

the disengageable stop is arranged vertically between the supporting frame and the intermediate plate, so that the disengageable stop is capable of applying the mechanical impulse to the upper panel by means of the supporting frame;

the intermediate supporting frame comprises a central orifice that is traversed by the disengageable stop so that the disengageable stop is arranged vertically between the intermediate plate and the upper panel and so that the disengageable stop is capable of applying the mechanical impulse directly to the upper panel.

Other features and advantages of the invention will appear on reading the following detailed description for the understanding of which reference will be made to the appended drawings in which:

BRIEF DESCRIPTION OF THE DRAWINGS

FIGS. 2A, 2B and 2C are cross sections along a vertical plane of the upper panel and of the supporting frame represented in FIG. 1, showing various actuation positions of the upper panel according to the invention;

FIGS. 7A, 7B, 7C and 7D are views similar to those of FIGS. 3A, 3B, 3C and 3D, showing a variant embodiment of the commutator according to the invention;

FIG. 10 is a view similar to that of FIG. 9, showing a variant embodiment of the invention in which the switches are grouped in pairs so that two adjacent switches are capable of establishing one and the same switch way;

FIGS. 11A and 11B are views similar to that of FIG. 10, in which the commutator comprises six pairs of switches that are arranged so that the upper face of the upper panel is divided into thirteen contact zones, and in which the commutator comprises lighting means making it possible to display different items of information.

DESCRIPTION OF THE INVENTION

For the description of the invention, in a non-limiting manner, the vertical, longitudinal and transverse orientations will be adopted according to the V, L, T marking indicated in the figures.

In the following description, identical, similar or analogous elements will be indicated by the same reference numbers.

Figure 1:
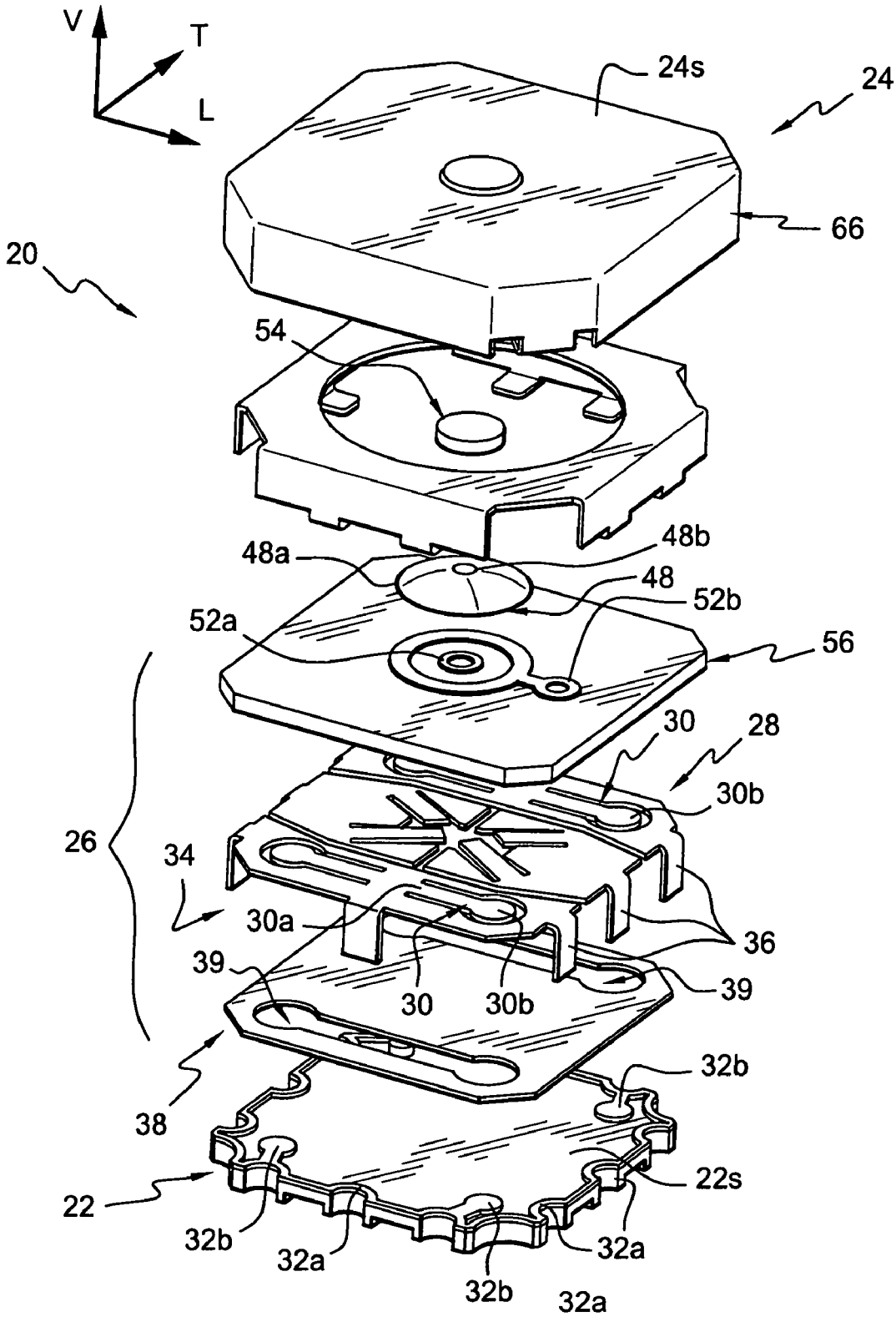
FIG. 1 is an exploded isometric view of a commutator according to the invention.

FIG. 1 shows an electric commutator 20 that is designed for the control of various functions of an electronic device such as for example a mobile telephone or a computer.

The commutator 20 consists of a vertical stack comprising a lower supporting frame 22 and an upper panel 24 that is mounted so as to be movable generally vertically relative to the frame 22.

According to the embodiment represented in particular in FIG. 1, the commutator 20 is of parallelepipedal shape, here the shape of a square, but it will be understood that the invention is not limited to this shape of the commutator 20; for example the commutator 20 is of generally circular shape as has been shown in FIGS. 12A and 12B.

To control the functions of the electronic apparatus on which the commutator 20 is mounted, the user uses a pointing element (not shown) such as a stylet or a digit, placing the pointing element in contact with the horizontal upper face 24*s* of the upper panel 24.

In response to this contact of the pointing element, an electronic control device (not shown) of the electronic apparatus applies a predefined action, such as for example the movement of a cursor on a display screen, in a direction associated with the position of the point of contact of the pointing element on the upper face 24*s* of the upper panel 24.

The commutator 20 comprises means 26 for determining the position of the point of contact of the pointing element on the upper face 24*s* of the upper panel 24 that comprise a plurality of electric switches 28, here four in number, on which the upper panel 24 is capable of acting selectively, according to the position of the point of contact of the pointing element.

When a switch 28 is actuated by the upper panel 24, this switch 28 closes an electric circuit that is associated with it, allowing an electric current to flow in this circuit to an electronic device for controlling the electronic apparatus. It is then said that the switch 28 establishes a switch way of the commutator 20.

Each switch 28 comprises two electric contacts 32*a*, 32*b* that are mounted on the frame 22 and that are capable of being connected electrically via a metal strip 30 under the action of the upper panel 24.

The metal strip 30 is made of an electrically conductive material. It comprises a first end 30*a* that is connected permanently to a first electric contact 32*a*, and a second free end 30*b* that is situated at a distance from the second electric contact 32*b*. The metal strip 30 is capable of being deformed elastically under the action of the upper panel 24, so that its second end 30*b* comes into contact with the second electric contact 32*b* to establish the associated switch way.

For this, the second electric contact 32*b* of each switch 28 is arranged on the horizontal upper face 22*s* of the frame 22 and the second end 30*b* of the associated metal strip 30 is situated vertically above and at a distance from this second electric contact 32*b*.

The metal strips 30 of all the switches 28 are all made by cutting and bending from a single horizontal metal plate 34 which simplifies the production of the commutator 20.

This metal plate 34 comprises several vertical lugs 36 via which the plate 34 is electrically connected to the first electric contacts 32*a* of all the switches 28. The first electric contacts 32*a* are then preferably connected to a common electric contact (not shown) and via which the metal plate 34 is mounted on the frame 22.

The metal plate 34 is held vertically above and at a distance from the upper face 22*s* of the frame by means of a flat spacer 38 made of an electrically insulating material.

The spacer 38 comprises openings 39 or windows that are situated in line with the second contacts 32*b* and that are traversed by the metal strips 30 when they come into contact with the second electric contacts 32*b*.

Each switch 28 is made so that, when it is actuated by the upper panel 24, it applies to the upper panel 24 a resistant force that corresponds to the elastic deformation of the associated strip 30, whose value is continuously variable according to the deformation of the strip 30, and that is transmitted to the pointing element by the upper panel 24.

According to a variant embodiment shown especially in FIGS. 2A to 2C, the switches are made so that they apply no resistant force to the upper panel 24.

According to the invention, the switches 28 are capable of being actuated selectively by the upper panel 24 under the action of the pointing element and according to the position of the pointing element on the upper face 24*s* of the upper panel 24.

According to a first aspect of the invention, the switches 28 are arranged on the frame 22 so that they divide the upper face 24*s* of the upper panel 24 into a plurality of zones that will hereafter be called contact zones 44. Each contact zone 44 is associated with at least one switch 28, and only this at least one switch 28, that is associated with a considered contact zone 44, is capable of being actuated by the upper panel 24 when the pointing element is in contact with the upper face 24*s* of the upper panel 24 in this considered contact zone 44.

In addition, and according to a second aspect of the invention, the upper panel 24 is mounted so as to be movable relative to the supporting frame 22 in a generally downward vertical movement under the action of the pointing element, and against a return force of the upper panel 24 to its initial upper position.

Thus, when the user acts on the upper panel 24, to control the electronic apparatus, he applies to the upper face 24*s* of the upper panel 24 an actuation force making it possible to cause the upper panel 24 to move downwards, which counters the return force applied by the return means 46 and which is combined, as appropriate, by the resistant force generated by the metal strips 30 that is also continuously variable.

Since the total value of the return forces applied to the upper panel 24 is continuously variable, the actuation force that the user applies is also continuously variable, and the user feels only this continuous variation of the actuation force.

This sensation is different from a tactile sensation that corresponds to a sudden variation of the resistant force, as is the case, for example, with the switches described in document U.S. Pat. No. 6,686,906.

FIGS. 2A to 2C show a first embodiment of the invention according to which two switches 28 are arranged on the frame 22, so as to divide the upper face 24*s* of the upper panel 24 into three contact zones 44, that here are a first central contact zone 44*a* and two side contact zones 44*b* arranged transversely on either side of the central contact zone 44*a* with each of which the pointing element is capable of coming into contact, as has been shown schematically by the arrows F1 in FIGS. 2B and 2C.

In addition, the return force of the upper panel to its initial upper position shown in FIG. 2A is here applied by return means that have been shown schematically by a spring 46, that are made so that the value of the return force is continuously variable, according to the movement of the upper panel 24 relative to the frame 22.

According to a variant embodiment of the invention, the return of the upper panel to its initial upper position is made only by the switches 28, particularly by means of the elastic strips 30.

As has been said above, the switches 28 are arranged on the frame 22 so that each of the contact zones 44 is associated with at least one switch 28. Here, the central contact zone 44*a* is associated with the two switches 28 and each of the two side contact zones 44*b* is associated with a single switch 28.

Thus, as can be seen in FIG. 2B, when the pointing element is in contact with the central contact zone 44*a*, the point of contact, where the actuation force F1 is applied, is situated transversely between the two switches 28. The upper panel 24 then moves vertically downwards to actuate the two switches 28.

On the other hand, as can be seen in FIG. 2C, when the pointing element is in contact with a side contact zone 44*b*, here the left side contact zone 44*b*, the upper panel 24 actuates the switch 28 associated with this side contact zone 44*b*, and it pivots relative to the frame 22, about a bearing point formed at this switch 28 so that it cannot actuate the other switch 28.

The pivoting of the upper panel is also helped by the return means 46. Thus, according to the invention, the upperface 24*s* of the upper panel 24 comprises three contact zones 44*a*, 44*b*, and the commutator 20 comprises two switches 28, and consequently two switch ways, which is less than the number of contact zones 44 that the upper face 24*s* of the upper panel 24 comprises.

As has been said above, the switches 28 are connected to an electronic control device that is made so that it is capable of determining which is the contact zone 44 with which the pointing element is in contact, according to the switch ways that have been established, then of controlling the electronic apparatus according to the command associated with the contact of the pointing element with this contact zone 44.

For example, with reference to the embodiment represented in FIGS. 2A to 2C, when the two switch ways that are associated with the two switches 28 are established, the electronic control device is capable of determining that the pointing element is in contact with the central contact zone 44*a*, and, when only one switch way is established, for example the switch way associated with the switch 28 situated transversely to the right of the frame 22, the control device is capable of determining that the pointing element is in contact with the right side contact zone 44*b*.

According to another aspect of the invention, the commutator 20 comprises means for generating a single impulse on the upper panel 24, in response to the action of the user by means of the pointing element, and irrespective of the number of switches 28 that are actuated by the upper panel 24.

This impulse is transmitted by the upper panel 24 to the pointing element to be felt by the user.

Thus, irrespective of the contact zone 44 with which the pointing element is in contact and the number of switches 28 actuated by the upper panel 24, the user feels a single impulse in response to his action, in the same manner as he feels an impulse when he acts on a conventional button.

As can be seen in FIG. 1, the means for generating the single impulse comprise a single element 48 that is mounted beneath the upper panel 24 and that is capable of being actuated by the upper panel 24.

The single element 48 forms a disengageable or retractable stop of the upper panel 24 in a high position, that is capable of changing state when the value of the pressure applied by the pointing element to the upper face 24*s* of the upper panel 24 is greater than a determined threshold value.

When it changes state, the single element 48 no longer forms a stop of the upper panel 24 which may then move suddenly downwards. During this sudden movement of the upper panel 24, the user feels a discontinuous variation of the resistance to the movement of the upper panel 24 that is interpreted by the user as a tactile sensation.

The disengageable element 48 here is dome-shaped, that is to say that it has a concave shape open downwards and with a vertical principal axis. It is arranged beneath the upper panel 24, and it is situated generally horizontally in line with the center of the upper panel 24. The disengageable element 48 is capable of collapsing by elastic deformation when the value of the pressure is greater than the threshold value. The disengageable element 48 then suddenly changes state according to an operation also called "collapsing".

Figure 3A:
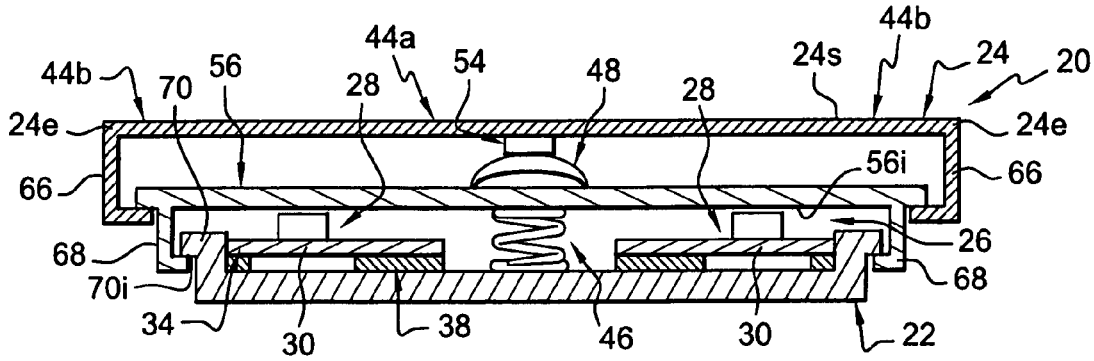
FIGS. 3A, 3B, 3C and 3D are cross sections along a vertical plane of the commutator represented in FIG. 1, showing various actuation positions of the upper panel according to the invention.
Figure 3B:
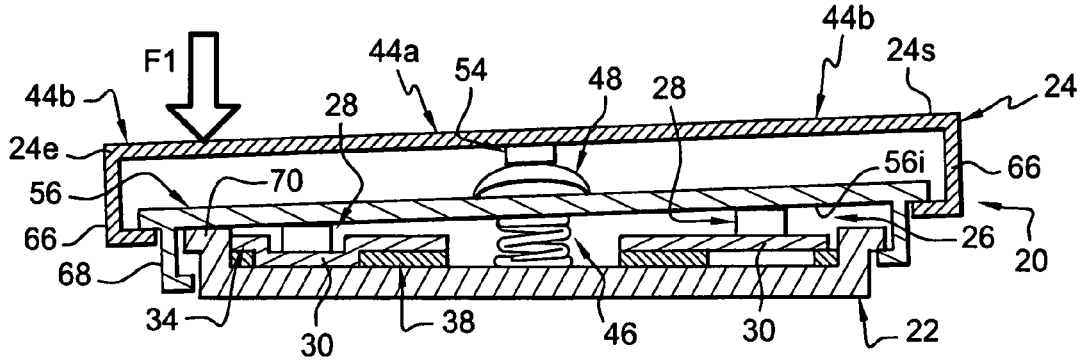
Figure 3C:
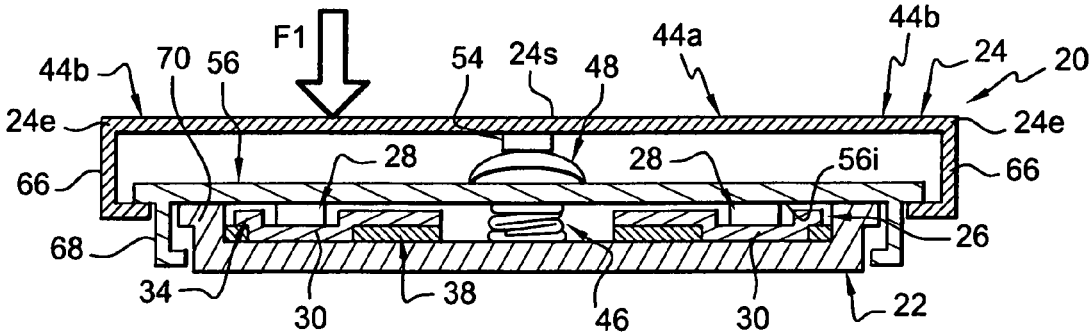
Figure 3D:
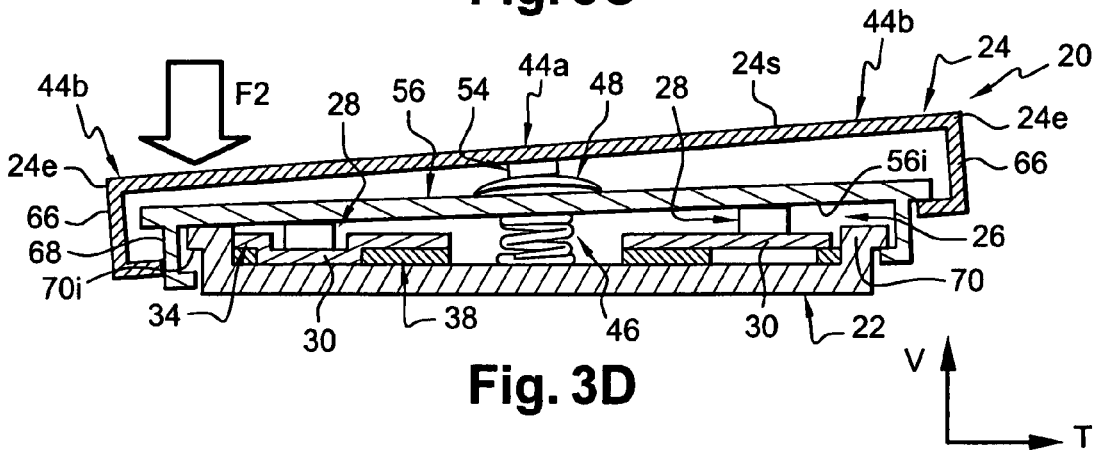

FIGS. 3B to 3D show a first embodiment of the commutator 20 comprising a disengageable element 48.

As can be seen in FIGS. 3B and 3C, when the value of the pressure applied to the upper face 24*s* of the upper panel 24 is less than the threshold value, as has been shown by the arrow F1, the value of the pressure is insufficient to cause the change of state of the disengageable element 48.

Consequently, the upper panel 24 is kept by the disengageable element 48 in an intermediate position in which only the switches 28 are actuated according to the contact zone 44 with which the contact element is in contact.

On the other hand, as has been shown in FIG. 3D, when the user applies to the upper face 24*s* of the upper panel 24 a control force F2 whose value is greater than the threshold value, the disengageable element 48 deforms and changes state, allowing the upper panel 24 to move suddenly downwards.

This sudden movement of the upper panel 24 is transmitted to the user via the pointing element, and is felt by the user as a tactile sensation representative of the control action that he has just made.

When the user ceases to apply this pressure, the upper panel 24 is returned elastically to the high rest position represented in FIG. 3A, and the disengageable element 48 returns to its stable rest state.

According to a preferred embodiment of the invention, the elastic return is provided by the disengageable element 48 itself.

As a variant shown in FIGS. 6A to 6D, the elastic return is carried out by return means 50, that are coil springs here.

As the upper panel 24 returns to its initial upper position, the disengageable element 48 again changes state to resume its initial shape, and it then applies a brief upward force to the upper panel 24. This new impulse thus generated by the disengageable element 48 reproduces another tactile sensation that is perceived by the user as confirmation of the end of the control action.

Here, the disengageable element 48 is situated generally in line with the geometric center of the upper panel 24. This positioning of the disengageable element makes it possible to limit the difference in amplitude of the pressure to be applied to the upper panel 24 to cause the deformation of the disengageable element, according to the location of the point of contact of the pointing element on the upper face 24*s* of the upper panel 24.

According to yet another aspect of the invention, the commutator 20 comprises means for detecting an additional control action consisting in applying to the upper face 24*s* of the upper panel 24 a pressure whose value is greater than a predefined threshold value, and irrespective of the contact zone 44 to which this control action is applied.

This allows the user to keep the pointing element in contact with the same contact zone 44 when he applies the control action.

It is therefore possible to apply a function of the electronic apparatus that is directly connected to the contact zone 44 with which the pointing element is in contact.

According to the invention, the means for detecting the control action consist in an electric switch that is capable of establishing another switch way of the commutator 20.

According to a preferred embodiment of this aspect of the invention, the means for detecting the control action and the element 48 for generating the impulse form a single sensor.

For this, as can be seen in FIG. 1, the disengageable element 48 is made of an electrically conductive material, that is capable of connecting two electric contacts 52*a*, 52*b* to establish the associated switch way.

The outer circular edge 48*a* of the disengageable element 48 is in permanent contact with a first electric contact 52*a* that is of circular shape, and the upper central portion 48*b* of the disengageable element 48, or the point, can be moved downwards when the disengageable element 48 deforms, so that its point 48*b* is capable of coming into contact with the second electric contact 52*b*.

An intermediate pushbutton 54 is arranged between the upper panel 24 and the disengageable element 48, to concentrate the forces making it possible to cause the deformation of the disengageable element 48 at the central portion 48*b* of the disengageable element 48.

Thus, when the commutator 20 is controlled, the upper panel 24 is capable of making two distinct and successive vertical movements under the action of the pointing element, namely a first movement downwards relative to the frame 22, for the selective actuation of the switches 28, and a second movement for the actuation of the sensor 48.

To make it possible to selectively actuate the switches 28 and the sensor 48, the commutator 20 comprises a plate 56 that is mounted so as to be movable relative to the frame 22 and relative to the upper panel 24.

According to a first embodiment, the plate 56 is mounted so as to be movable relative to the frame 22 and relative to the upper panel 24 so that the plate 56 is integral with the upper panel 24 in movement relative to the frame 22 when the switches 28 are actuated for the detection of the position of contact of the pointing element on the upper face 24*s* of the upper panel 24, that is to say when the value of the pressure applied by the pointing element is less than the threshold value, and so that subsequently, when the value of the pressure becomes greater than or equal to the threshold value causing the change of state of the disengageable element 48, the plate 56 is then integral with the frame 22 and the upper panel 24 moves relative to the frame 22 and relative to the plate 56.

FIGS. 3A to 3D show a first embodiment of the commutator 20 according to which the plate 56 is arranged vertically between the upper panel 24 and the frame 22.

Consequently, since the switches 28 are arranged on the frame 22, the switches 28 are actuated by the upper panel 24 via the plate 56.

In addition, the sensor 48 is arranged between the plate 56 and the upper panel 24, so that the mechanical impulse is applied directly to the upper panel.

The disengageable element 48 is also made so that it is compressed vertically and without vertical clearance between the upper panel 24 and the plate 56.

The outer transverse and longitudinal ends 24*e* of the upper panel 24 are extended vertically downwards by lower hooks 66 that are capable of pressing upwards against the lower horizontal face 56*i* of the plate 56, keeping the disengageable element 48 in a prestress position making it possible to remove the vertical clearances between the upper panel 24, the plate 56 and the disengageable element 48.

The plate 56 also comprises lower hooks 68 that press upwards against a lower face 70*i* of a peripheral rim 70 of the frame 22.

Thus, the disengageable element 48 applies to the upper panel 24 and to the plate 56 opposite forces tending to vertically separate the upper panel 24 from the plate 56. The disengageable element 48 is made so that the value of the forces that it applies to the upper panel 24 and to the plate 56 is sufficient for the plate 56 to remain immobile relative to the upper panel 24 when the pressing element applies to the upper face 24*s* of the upper panel 24 a pressure whose value is less than the predefined threshold value, and irrespective of the location of contact of the pointing element on the upper face 24*s* of the upper panel 24.

Thus, as can be seen in FIG. 3B, when the contact element is in contact with a side contact zone 44*b*, here the left side contact zone 44*b*, and the value of the pressure F1 is less than the threshold value, the plate 56 moves vertically downwards relative to the frame 22, integrally with the upper panel 24, to actuate only the switch 28 associated with this side contact zone 44*b*, that is to say that the plate 56 and the upper panel 24 pivot relative to the frame 22 about the bearing point formed at this switch 28 so that the plate cannot actuate the other switch 28.

Also, as can be seen in FIG. 3C, when the pointing element is in contact with the central contact zone 44*a*, and the value of the pressure F1 is less than the threshold value, the plate 56 moves vertically downwards relative to the frame 22, integral with the upper panel 24, to actuate the two contacts 28.

On the other hand, as can be seen in FIG. 3D, when the value of the pressure F2 is greater than the threshold value, the disengageable element 48 deforms, then allowing a downward movement of the upper panel 24 relative to the plate 56.

The pressure F1, F2 applied by the pointing element to the upper face 24*s* of the upper panel 24 usually increases from a zero value to a value greater than the threshold value causing the deformation of the disengageable element 48.

Consequently, during the actuation of the commutator 20, the plate 56 moves first relative to the frame and in a manner integral with the upper panel 24, as has been shown in FIGS.

3B and 3C, and secondly, the plate is immobile relative to the frame 22 and only the upper panel 24 moves.

In addition, as can be seen in FIG. 3D, the plate 56 is connected to the upper panel and to the frame 22 so that, after the relative movements of the upper panel 24, of the plate 56 and of the frame 22, the plate frame 56 identically actuates the switches 28 when the value of the pressure is less than or greater than the threshold value.

When the action of the pointing element is relaxed, the plate 56 is moved upwards relative to the plate by the return means 46 and the disengageable element 48 causes an upward movement of the upper panel 24 relative to the plate 56.

According to the embodiment shown in FIGS. 3A to 3D, the upper panel 24 is mounted so as to be movable relative to the frame 22 by means of the plate 56.

FIGS. 4A to 4D show a variant embodiment of the means for connecting the upper panel 24 and the plate 56 relative to one another and relative to the frame 22.

According to this variant, the hooks 66 of the upper panel are capable of pressing upwards against the lower face 56*i* of the plate 56 and also against the opposite lower face 70*i* of the rim 70 of the frame 22.

Figure 4A:
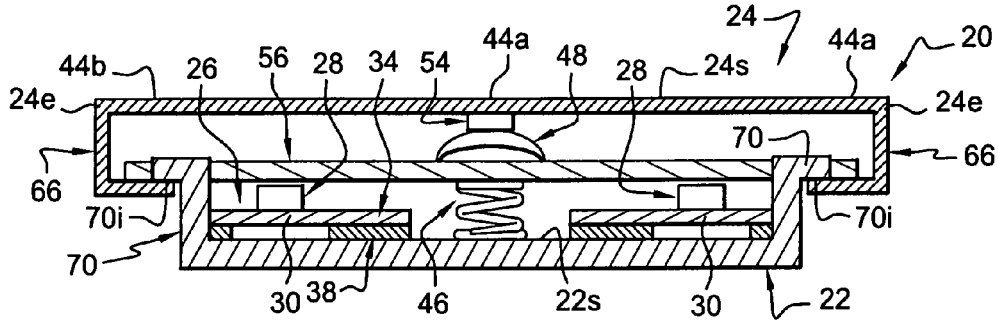
FIGS. 4A, 4B, 4C and 4D are views similar to those of FIGS. 3A, 3B, 3C and 3D, showing a variant embodiment of the commutator according to the invention.
Figure 4B:
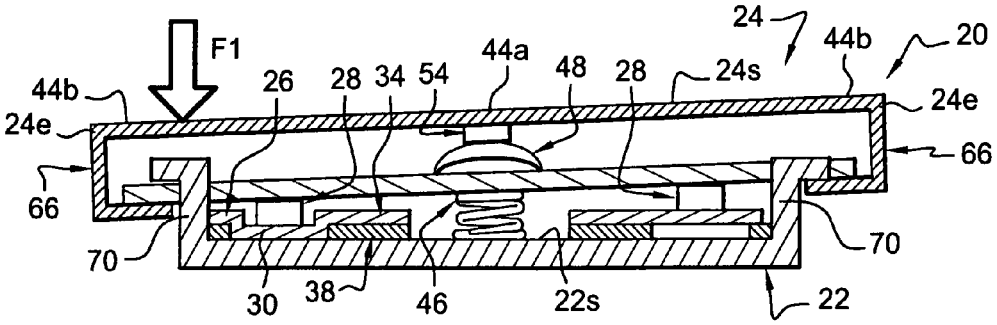
Figure 4C:
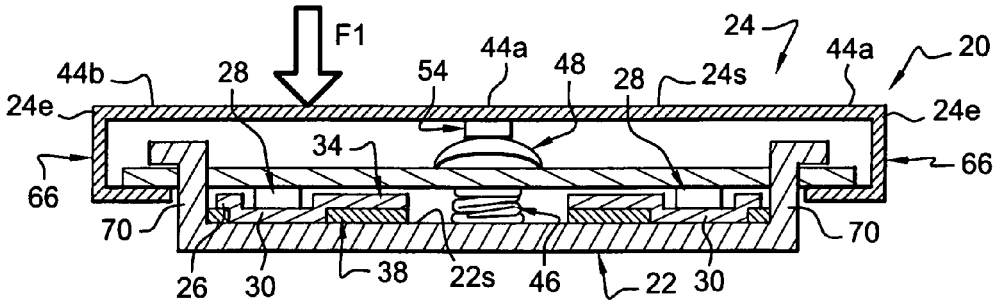
Figure 4D:
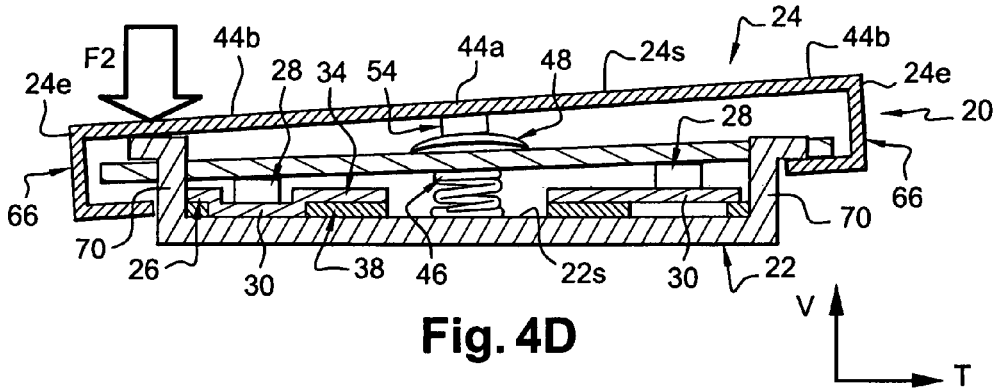

Consequently, according to this variant, the upper panel 24 supports the plate 56 so that they are integral in vertical downward movement when the value of the pressure F1 is less than the threshold value, as has been shown in FIGS. 4B and 4C.

Figure 5A:
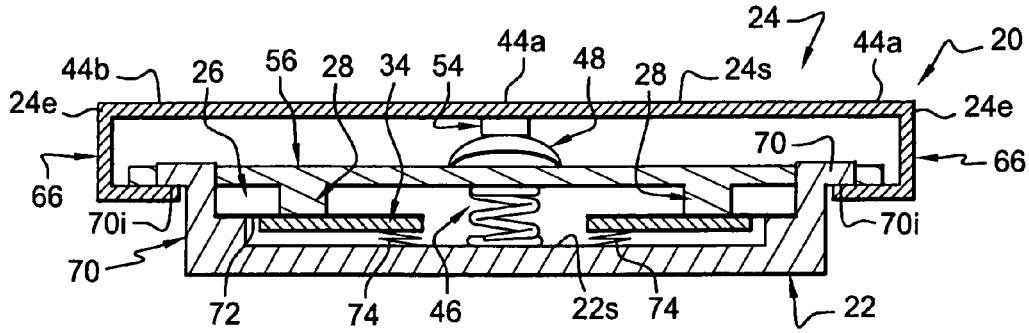
FIGS. 5A, 5B, 5C and 5D are views similar to those of FIGS. 3A, 3B, 3C and 3D, showing a variant embodiment of the commutator according to the invention.
Figure 5B:
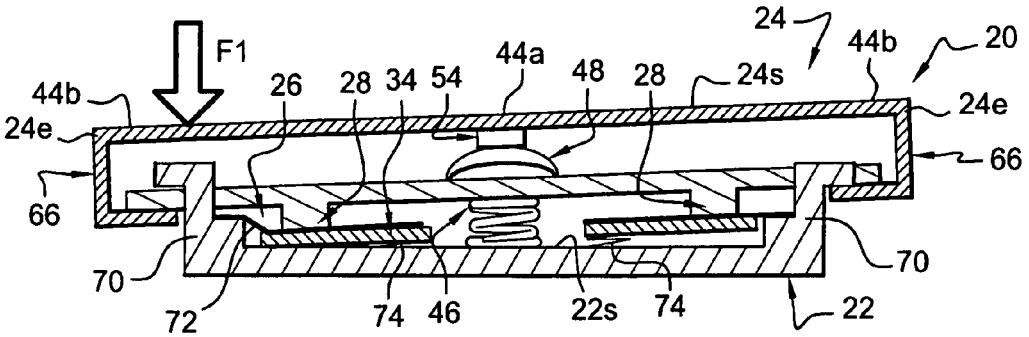
Figure 5C:
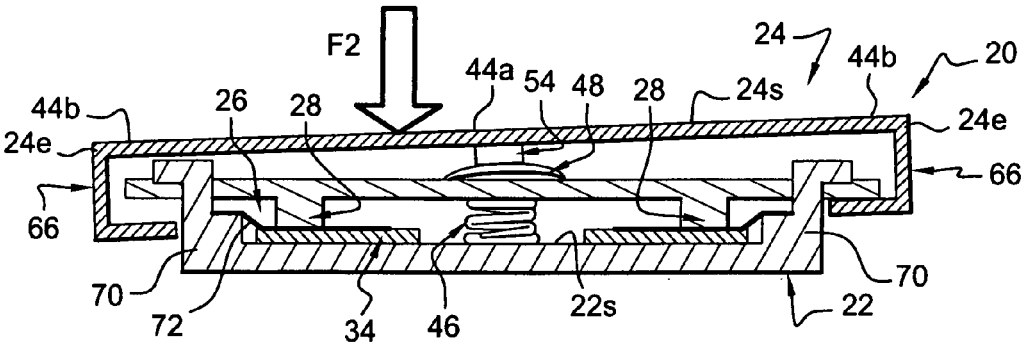
Figure 5D:
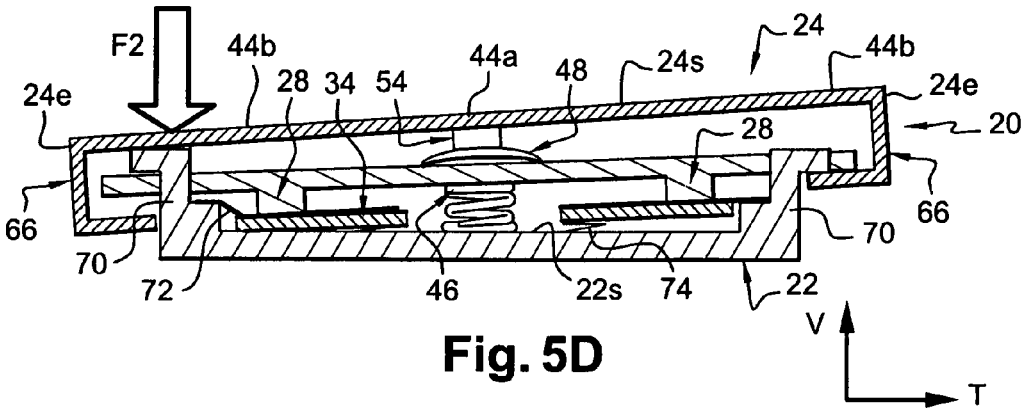

FIGS. 5A to 5C show another variant embodiment of the commutator 20 according to the invention in which the metal plate 34 of the means 26 for determining the position of the point of contact of the pointing element on the upper face 24*s* of the upper panel 24 is mounted so as to be movable relative to the frame 22, and integral with the plate 56.

The metal plate 34 is therefore rigid and not deformable, and it comprises lower bosses (not shown) each of which is capable of coming into contact with a second associated fixed contact 32*b* to establish the associated switch way, according to the contact zone 44 with which the pointing element is in contact.

The commutator also comprises elastic means, for returning the metal plate 34 to its high position represented in FIG. 5A, which here consist in coil springs 74 that are made so as to generate a continuously variable resistant force on the plate 56 and hence on the upper panel 24, so as to generate no tactile sensation when the value of the pressure F1 is less than the threshold value.

In addition, according to this embodiment, the metal plate 34 is covered with a protective film 72 providing protection for the fixed contacts 32*a*, 32*b* from water and pollutants.

FIGS. 6A to 6D show another variant embodiment of the commutator in which the disengageable element 48 is arranged between the plate 22 and the upper panel 24, traversing a central orifice 78 of the plate 56.

In addition, the electric contacts 52*a*, 52*b* associated with the disengageable element 48 are mounted on the upper face 22*s* of the frame 22, similarly to the fixed contacts 32*a*, 32*b* of the means 26 for detecting the position of the point of contact of the pointing element on the upper face 24*s* of the upper panel 24.

Thus, all the electric contacts 32*a*, 32*b*, 52*a*, 52*b* are mounted on the upper face 22*s* of the frame 22 which makes it possible to simplify the electric connections between the commutator and the electronic control device.

In addition, the commutator 29 here also comprises a protective film 72 for all the electric contacts against polluting elements.

Figure 6A:
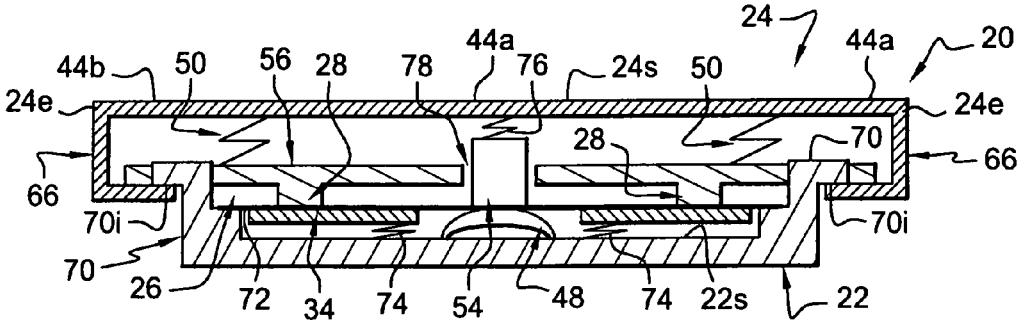
FIGS. 6A, 6B, 6C and 6D are views similar to those of FIGS. 3A, 3B, 3C and 3D, showing a variant embodiment of the commutator according to the invention.
Figure 6B:
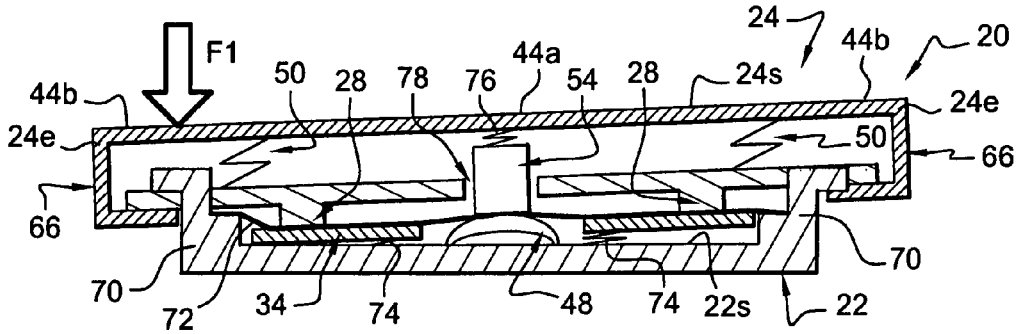
Figure 6C:
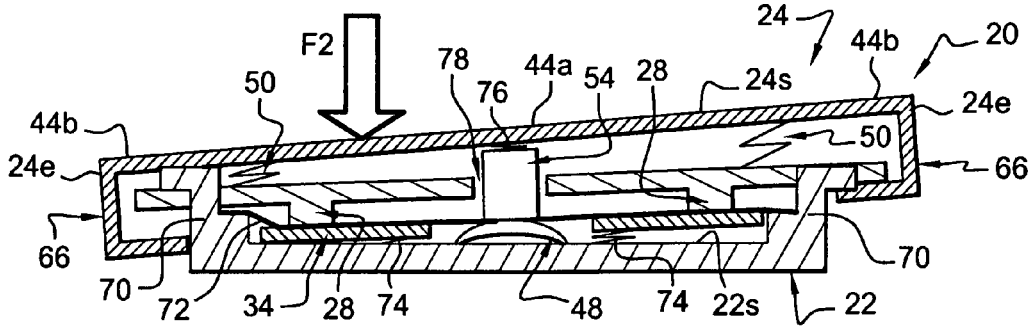
Figure 6D:
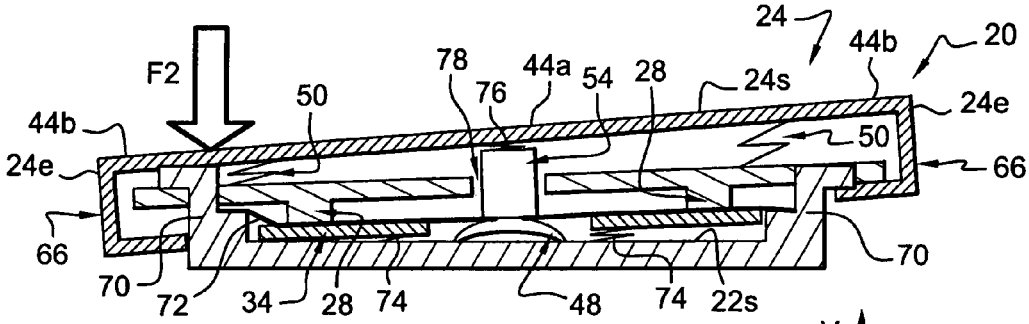
Figure 6D:
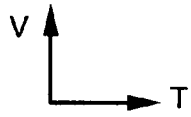

Finally, the commutator comprises an elastic element such as a spring 76 that is arranged between the pushbutton 54 and the upper panel, that is made on the one hand to limit the vertical clearances of the upper panel 24 relative to the frame when it is in the rest position represented in FIG. 6A, and also to allow a downward movement of the upper panel 24 without immediately actuating the disengageable element 48, thereby allowing the upper panel 24 to actuate the switches 28 before actuating the disengageable element.

The commutator also comprises elastic return means 50 making it possible to keep the plate 56 away from the upper panel when the value of the pressure F1 is less than the threshold value.

According to a second embodiment shown in FIGS. 7A to 7D, the plate 56 is mounted so as to be movable relative to the frame 22 and relative to the upper panel 24 so that the upper panel 24 moves vertically downwards relative to the plate 56 and relative to the frame 22 during the actuation of the switches 28 for the detection of the position of contact of the pointing element on the upper face 24*s* of the upper panel 24, that is to say when the value of the pressure applied by the pointing element is less than the threshold value, and so that subsequently, when the value of the pressure is greater than or equal to the threshold value causing the change of state of the dome-shaped element 48, the frame 22 is integral with the upper panel 24 in movement relative to the plate 56. According to this second embodiment, the plate 56 is arranged vertically beneath the frame 22 and the disengageable element 48 is arranged vertically between the frame 22 and the plate.

Consequently, the upper panel 24 directly actuates the switches 28 and the impulse generated by the disengageable element 48 is transmitted to the upper panel 24 by means of the frame 22.

The metal plate 34 also comprises a connecting strip 80 that is capable of deforming elastically and that interacts with the disengageable element 48 for the upward return of the frame 22 when the user relaxes his action on the upper panel.

According to a variant embodiment, the connecting strip supports the electric contacts 52*a*, 52*b* associated with the disengageable element 48.

According to a variant embodiment, not shown, of this embodiment, the disengageable element is directly connected to the upper panel to apply the impulse.

Accordingly, the frame 22 comprises a central orifice that is traversed by the pushbutton 54, similarly to the embodiment represented in FIGS. 6A to 6D.

With reference to FIGS. 2A to 7D, an embodiment of the invention has been described in which the means for detecting the position of the point of contact of the pointing element on the upper face 24*s* of the upper panel 24 comprise two switches 28 dividing the upper face 24*s* of the upper panel 24 into three contact zones 44.

However, it will be understood that the invention is not limited to this embodiment of the detection means, which may comprise a larger number of different switches 28 and contact zones 44.

Figure 8:
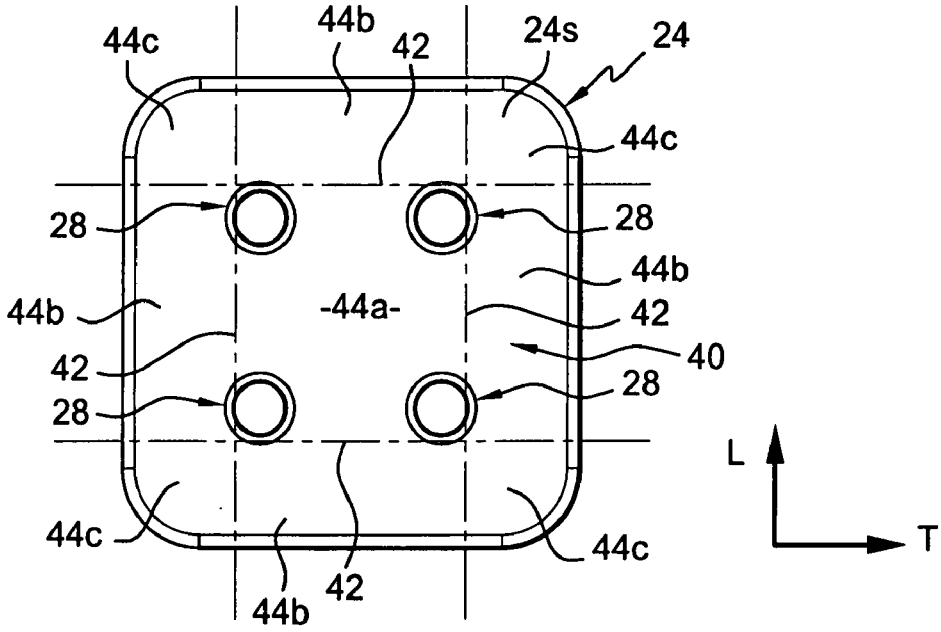
FIG. 8 is a schematic representation, seen from above, of the commutator represented in FIG. 1, comprising four switches that are arranged to divide the upper face of the upper panel into nine actuation zones.

Thus, according to another embodiment of the invention, as can be seen for example in FIGS. 1 and 8, the means for detecting the position of the point of contact of the pointing element on the upper face 24*s* of the upper panel 24 comprise four switches 28 that are arranged on the frame 22 on the points of a polygon 40, here a square, so that the sides of the square 40 are delimited by two adjacent switches 28.

In addition, the switches are arranged so that the polygon 40 is horizontally centered relative to the upper panel 24, that is to say that the center of the polygon 40 is situated vertically in line with the center of the upper panel 24.

The upper face 24*s* of the upper panel 24 is divided into a plurality of contact zones 44, here nine contact zones 44, as can be seen in FIG. 8.

As has been said above, each contact zone 44 is associated with at least one of the switches 28, so that, when the pointing element comes into contact with a contact zone 44, only the switch or switches 28 that are associated with this contact zone 44 are actuated.

The upper face 24*s* of the upper panel 24 comprises a central contact zone 44*a*, that is situated inside the polygon 40, and that is associated with all the switches 28, so that, when all the switch ways are established, the electronic control device is capable of determining that the pointing element is in contact with this central contact zone 44*a*.

According to a variant embodiment, the electronic control device is made so that it is capable of determining that the pointing element is in contact with the central contact zone 44*a* when at least two switch ways associated with two switches 28 that are not adjacent are established, for example two switch ways associated with two switches that are diametrically opposed relative to the center of the polygon 40, or else when three switch ways are established.

The upper face 24*s* of the upper panel 24 also comprises a first series of contact zones 44*b*, each contact zone 44*b* of this first series comprising a side that is common with a side 42 of the polygon, and this contact zone 44*b* is associated with the two switches 28 delimiting this side 42 of the polygon 40.

Here, the first series of contact zones 44*b* comprises four contact zones 44*b* that are respectively situated transversely to the right and to the left of the central contact zone 44*a*, and longitudinally in front of and behind the central contact zone 44*a*.

Finally, the upper face 24*s* of the upper panel 24 comprises a second series of contact zones 44*c*, of which each contact zone 44*c* of this first series is associated with the switch 28 forming a point of the polygon 40.

The contact zones 44*c* of the second series of contact zones are therefore generally offset at a 45? angle relative to the contact zones 44*b* of the first series of contact zones, about a central vertical axis (not shown) of the upper panel 24.

The contact zones 44*b*, 44*c* of the first series of contact zones and of the second series of contact zones are therefore distributed alternately about the center of the polygon so that each contact zone 44*c* of the second series of contact zones is arranged between two contact zones 44*b* of the first series of contact zones and each contact zone 44*b* of the first series of contact zones is arranged between two contact zones 44*c* of the second series of contact zones.

As has been said above, the electronic control device is capable of controlling the electronic apparatus according to the contact zone 44 with which the pointing element is in contact, that is to say according to the switch 28 or the switches 28 that have been actuated.

For example, when the pointing element is in contact with a contact zone 44*b* of the first series of contact zones, the electronic control device is capable of controlling a movement of a cursor on a display screen of the electronic apparatus, in a direction associated with the position of the contact zone 44*b*, such as a slide towards the right when the pointing element is in contact with the contact zone 44*b* situated transversely to the right of the polygon 40.

According to a variant embodiment of the invention, the electronic control device is capable of detecting the transition of the contact of the pointing element from one contact zone 44 to another adjacent contact zone 44.

This is particularly the case when the pointing element moves over the upper face 24*s* of the upper panel 24 in a circular movement, rotating about the central contact zone 44*a*.

In this case, the electronic device detects that the point of contact of the pointing element on the upper panel moves from a contact zone 44 of the first or of the second series of contact zones to the adjacent contact zone of the second or of the first series of contact zones respectively.

Figure 9:
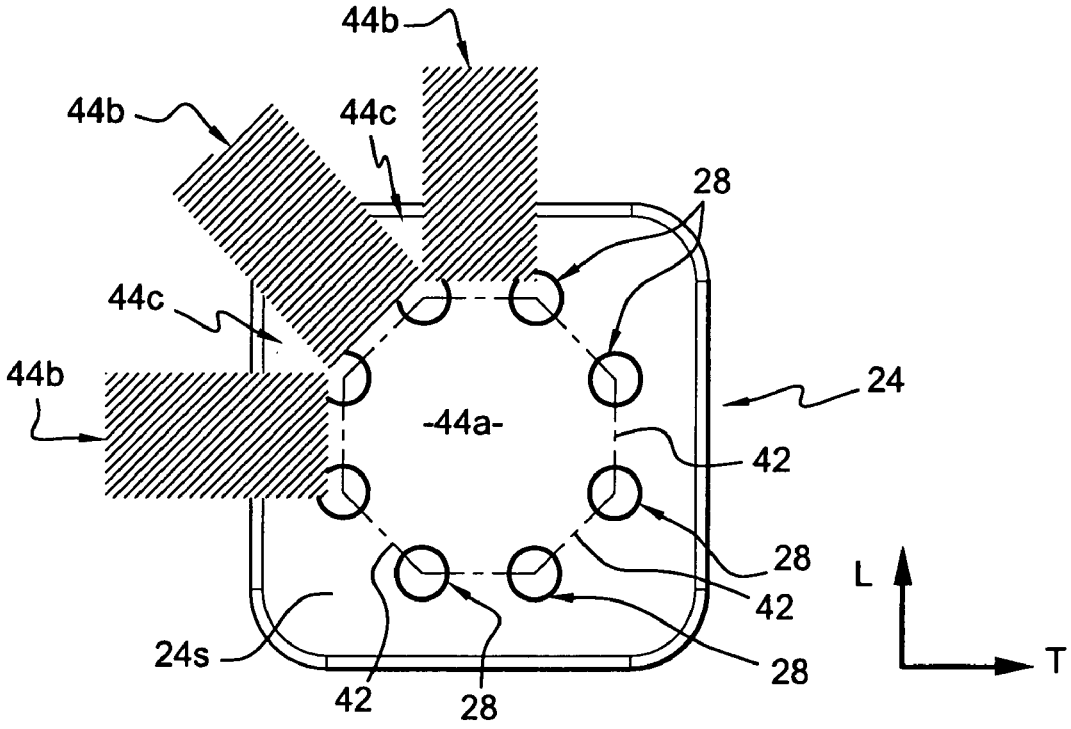
FIG. 9 is a view similar to that of FIG. 8, showing a variant embodiment of the invention in which the commutator comprises eight switches.

FIG. 9 shows a variant embodiment of the commutator 20 which comprises eight switches 28 that are arranged on the frame 22 so as to form a regular octagon.

According to this variant embodiment, the upper face 24*s* of the upper panel 24 comprises seventeen contact zones 44, that is to say a central contact zone 44*a*, eight contact zones 44*b* of the first series of contact zones, three of which contact zones 44*b* are shaded in FIG. 9. Each contact zone 44*b* is associated with two adjacent switches 28, and the contact zones 44*b* of this first series of contact zones are distributed angularly at 45? about the vertical central axis of the upper panel 24.

Finally, the upper face 24*s* of the upper panel 24 comprises eight contact zones 44*c* of the second series of contact zones of which each contact zone 44*c* is associated with a single switch 28.

According to this embodiment, the commutator 20 comprises a larger number of contact zones 44 which makes it possible to increase the number of functions that may be controlled from the commutator 20.

When the pointing element is in contact with a contact zone 44*c* of the second series of contact zones, the upper panel 24 is moved relative to the frame 22 so that it actuates a single switch 28 associated with this contact zone 44*c*.

However, such a position of actuation of a single switch 28 by the upper panel 24 is a relatively unstable position of the upper panel 24 relative to the frame, and consequently the upper panel 24 may move relative to the position in which it actuates a single switch 28 to a position in which it actuates two adjacent switches 28. Two switch ways are then established, and the electronic device may then interpret this movement of the upper panel 24 as a movement of the pointing element on the upper face 24*s* of the upper panel 24 from one contact zone 44 to another.

FIG. 10 shows another variant embodiment of the commutator 20 in which the switches 28 are grouped in pairs so that the two switches 28 that are adjacent and belong to one and the same pair are capable of establishing one and the same switch way.

Thus, the commutator 20 comprises two switches 28 associated with each switch way, and consequently, according to the embodiment represented in FIG. 10, the commutator 20 comprises four switch ways and eight switches 28.

In a manner similar to the embodiment described above, for which the commutator 20 comprises four switches 28, the first series of contact zones then comprises first contact zones 44*b* that are respectively situated transversely to the right and to the left of the central contact zone 44*a* and longitudinally in front of and behind the central contact zone 44*a*, of which each of these first contact zones 44*b* is associated with the two switches 28 of one and the same pair of switches 58, and is therefore associated with a single switch way.

The first series of contact zones also comprises second contact zones 44*b* that are offset angularly at 45? relative to the first contact zones 44*b*, and each of which second contact zones 44*b* is associated with two switches 28 of two distinct pairs of switches 58, and hence with two switch ways.

Thus, when a single switch way is established, it means that a single switch 28 is actuated, that is to say that the pointing element is in contact with a contact zone 44*c* of the second series of contact zones or else it means that the two switches 28 of one and the same pair of switches 58 are both actuated, that is to say that the pointing element is in contact with a first contact zone 44*b* of the first series of contact zones.

Each switch way is then associated with a first contact zone 44*b* of the first series of contact zones and with two contact zones 44*c* of the second series of contact zones that are arranged on either side of the first contact zone.

Thus, according to this embodiment of the invention, the position of actuation of the upper panel 24 corresponding to the establishment of a single switch way is relatively stable relative to the embodiment shown in FIG. 8, so the risk that the upper panel 24 moves relative to this actuation position is reduced.

FIGS. 11A and 11B show another embodiment of a commutator 20 according to the invention for its application to a mobile phone, or else to a motor vehicle navigator arranged on a central console of a vehicle, in which the number of switches 28 is determined so that the upper face 24*s* of the upper panel 24 comprises a number of contact zones 44 making it possible to form a keypad of a telephone in the shape of a circular dial.

For this, the upper panel 24 of the commutator 20 consists of a horizontal disc, and its upper face is divided so that the contact zones 44 of the first series of contact zones and/or of the second series of contact zones form angular sectors of a circular ring, the central contact zone 44*a* being arranged in the center of this ring.

In addition, each of these angular sectors is associated with a character 60 such as a number or one of the symbols hash "#" or asterisk "*" of the telephone keypad, and the central contact zone 44*a* is associated with one or more functions of the telephone, particularly those for establishing or terminating a telephone call.

According to a preferred embodiment, the commutator 20 comprises twelve switches 28, so that each angular sector of the ring corresponds to a contact zone 44*b* of the first series of contact zones defined above.

According to a variant of this embodiment, the twelve switches 28 are grouped in pairs of switches 58, as has been described with reference to the embodiment represented in FIG. 10.

The commutator 20 then comprises six switch ways that are associated with thirteen actuation positions of the upper panel 24.

According to another variant embodiment, the commutator 20 shown in FIGS. 11A and 11B comprises means (not shown) of lighting the upper panel 24 that are made so as to selectively light certain portions of the upper panel 24, according to the operating mode of the electronic apparatus on which the commutator 20 is mounted.

Here, the lighting means are made so as to light the numbers 60 and the symbols 62 that have been shown darkened in FIG. 11A, when the electronic apparatus operates as a telephone, and so as to light directional arrows 64, that have been shown darkened in FIG. 11B, when the apparatus is in an operating mode for the control of the display or movement of a cursor on a display screen of the electronic apparatus.

Accordingly, the upper panel 24 comprises translucent portions that are capable of conducting the light produced by these selective lighting means. For example, the translucent portions form the numbers 60, the symbols 62 and the arrows 64 of the upper panel 24.

In addition, the commutator comprises several light sources (not shown) that are arranged beneath the upper panel 24 and that are capable of being activated selectively for the lighting of the translucent portions.

What is claimed is:

1. An electric commutator (20) with multiple switch ways which includes a horizontal upper panel (24) with an upper face (24s), a supporting frame (22) and means (26) for locating a point of contact of a pointing element on the upper face (24s) of the upper panel (24), wherein said means for locating comprises a plurality of electric switches (28) that are arranged on the supporting frame (22) and that are capable of being actuated selectively by the upper panel (24) according to the location of the point of contact of the pointing element on the upper face (24*s*) of the upper panel (24) and that are made so that, when a switch (28) is actuated, it applies to the upper panel (24) a resistant force, characterized in that:

the switches (28) are distributed on the supporting frame (22) so as to divide the horizontal upper face (24s) of the upper panel (24) into a plurality of contact zones (44), the number of which contact zones (44) is greater than the number of switches (28), so that when the pointing element is in contact with one of the said contact zones (44), at least one switch (28) that is associated with said contact zone (44) is actuated by the upper panel (24); and the upper panel (24) is mounted so as to be movable relative to the supporting frame (22) in a generally downward vertical movement, against an elastic return force of the upper panel (24) to an initial position of which the value of the return force is continuously variable, so as to generate no tactile sensation in response to the action of the pointing element.

2. The commutator (20) according to claim 1, characterized in that:

the commutator comprises a single element (48) that is capable of generating a single mechanical impulse of vertical principal orientation on the upper panel (24) under the pressure of the pointing element on the upper panel (24), irrespective of the number of switches (28) that have been actuated by the upper panel (24).

3. The commutator (20) according to claim 2, characterized in that:

the single element (48) forms a disengageable stop of the upper panel (24) in a high position that is capable of changing state to generate the mechanical impulse when the value of the pressure of the pressing element on the upper face (24*s*) of the upper panel (24) is greater than a predefined threshold value.

4. The commutator (20) according to claim 3, characterized in that:

the commutator comprises means (52*a*, 52*b*) for detecting at least one control action consisting in the application of a pressure on the upper face (24*s*) of the upper panel (24) by means of the pointing element, of which the value of the pressure is greater than or equal to the said predetermined threshold value, and irrespective of the contact zone (44) with which the pointing element is in contact.

5. The commutator (20) according to claim 4, characterized in that:

the disengageable element (48) and the detection means (52*a*, 52*b*) consist of a single electronic switch that is arranged generally in line with the center of the upper panel (24).

6. The commutator (20) according to claim 1, characterized in that:

the switches (28) are arranged on the frame (22) forming the points of a polygon whose center is situated generally in line with the center of the upper panel (24), and in that each contact zone (44) is partly delimited by this polygon.

7. The commutator (20) according to claim 6, characterized in that:

the upper face (24*s*) of the upper panel (24) comprises a central contact zone (44*a*) that is arranged inside the said polygon, a first series of contact zones (44*b*) that are situated outside the polygon and each contact zone (44*b*) of which is associated with a side of the polygon, and a second series of contact zones (44*c*) that are situated outside the polygon and each contact zone (44*c*) of which is associated with a point of the polygon, so that the contact zones (44*b*, 44*c*) of the first series and of the second series are distributed alternately about a central vertical axis of the upper panel (24).

8. The commutator (20) according to claim 7, characterized in that:

each contact zone (44*b*) of the first series is associated with two adjacent switches (28) delimiting the side of the polygon that is associated with the said contact zone.

9. The commutator (20) according to claim 7, characterized in that:

each contact zone (44*c*) of the second series is associated with the switch (28) forming the point of the polygon that is associated with the said contact zone (44*c*).

10. The commutator (20) according to claim 7, characterized in that:

the central contact zone (44*a*) is associated with at least two non-adjacent switches (28).

11. The commutator (20) according to claim 7, characterized in that:

two adjacent switches (28) are capable of establishing one and the same switch way so that the switch way associated with these two adjacent switches (28) is established when the pointing element is in contact with the contact zone (44*b*) of the first series that is associated with these two adjacent switches (28) or when the pointing element is in contact with one or other of the two contact zones (44*c*) of the second series that are arranged on either side of the said contact zone (44*b*) of the first series that is associated with these two switches (28).

12. The commutator (20) according to claim 3, characterized in that:

the commutator comprises an intermediate plate (56) that is arranged vertically between the supporting frame (22) and the upper panel (24), and that is mounted so as to be movable relative to the frame (22) and relative to the upper panel (24), so that the plate (56) is capable of moving relative to the frame (22) in a manner integral with the upper panel (24), when the value of the pressure is less than the threshold value, and so that the upper panel (24) moves relative to the plate (56) and relative to the frame (22) when the value of the pressure is greater than the threshold value.

13. The commutator (20) according to claim 12, characterized in that:

the upper panel (24) is capable of actuating the switches (28) by means of the intermediate plate (56), when the value of the pressure is less than the said threshold value.

14. The commutator (20) according to claim 12, characterized in that:

the disengageable stop (48) is arranged vertically between the upper panel (24) and the intermediate plate (56), so that it is capable of applying the mechanical impulse directly to the upper panel (24).

15. The commutator (20) according to claim 12, characterized in that:

the intermediate plate (56) comprises a central orifice (78) that is traversed by the disengageable stop (48) so that the disengageable stop (48) is arranged vertically between the supporting frame (22) and the upper panel (24) and so that the disengageable stop (44*b*) is capable of applying the mechanical impulse directly to the upper panel (24).

16. The commutator (20) according to claim 3, characterized in that:

the commutator comprises a lower plate (56) that is arranged vertically beneath the supporting frame (22) and the upper panel (24), and relative to which the frame (22) and the upper panel (24) are movably mounted, so that the upper panel (24) moves relative to the plate (56) and relative to the frame (22) when the value of the pressure is less than the threshold value, and so that the frame (22) is capable of moving relative to the plate (56) in a manner integral with the upper panel (24), when the value of the pressure is greater than the threshold value.

17. The commutator (20) according to claim 16, characterized in that:

the upper panel (24) is capable of actuating the switches (28) directly when the value of the pressure is less than the said threshold value.

18. The commutator (20) according to claim 16, characterized in that:

the disengageable stop (44*b*) is arranged vertically between the supporting frame (22) and the intermediate plate (56), so that the disengageable stop (44*b*) is capable of applying the mechanical impulse to the upper panel (24) by means of the supporting frame (22).

19. The commutator (20) according to claim 16, characterized in that:

the intermediate supporting frame (22) comprises a central orifice that is traversed by the disengageable stop so that the disengageable stop (44*b*) is arranged vertically between the intermediate plate (56) and the upper panel (24) and so that the disengageable stop (44*b*) is capable of applying the mechanical impulse directly to the upper panel (24).

* * * * *